US009788388B2

(12) United States Patent
Ooghe et al.

(10) Patent No.: US 9,788,388 B2
(45) Date of Patent: Oct. 10, 2017

(54) METHOD FOR CONTROLLING ILLUMINATION FOR AN OPTICAL DISPLAY SYSTEM

(71) Applicant: BARCO N.V., Kortrijk (BE)

(72) Inventors: Jurgen Hector Ooghe, Gavere (BE); Jeroen Lisbeth Remi Boonen, Nazareth (BE)

(73) Assignee: BARCO N.V., Kortrijk (BE)

( * ) Notice: Subject to any disclaimer, the term of this patent is extended or adjusted under 35 U.S.C. 154(b) by 0 days.

(21) Appl. No.: 15/036,896

(22) PCT Filed: Nov. 21, 2013

(86) PCT No.: PCT/EP2013/074324
§ 371 (c)(1),
(2) Date: May 16, 2016

(87) PCT Pub. No.: WO2015/074695
PCT Pub. Date: May 28, 2015

(65) Prior Publication Data
US 2016/0302282 A1 Oct. 13, 2016

(51) Int. Cl.
*H05B 33/08* (2006.01)
*G09G 3/34* (2006.01)

(52) U.S. Cl.
CPC ..... *H05B 33/0869* (2013.01); *G09G 3/3413* (2013.01); *H05B 33/0848* (2013.01); *G09G 2310/0235* (2013.01); *G09G 2320/041* (2013.01); *G09G 2320/043* (2013.01); *G09G 2320/064* (2013.01);
(Continued)

(58) Field of Classification Search
CPC ..... H05B 33/0854; H05B 37/0272; H05B 33/0869; H05B 33/0872
USPC ..... 315/247, 185 S, 291, 307–326, 209 R, 315/274–289, 149–159
See application file for complete search history.

(56) References Cited

U.S. PATENT DOCUMENTS 8,175,841 B2 5/2012 Ooghe
8,278,846 B2 * 10/2012 Roberts ..... G09G 3/3413 315/224
(Continued)

FOREIGN PATENT DOCUMENTS

WO 2012/140634 A1 10/2012

OTHER PUBLICATIONS

International Search Report (ISR) dated Jan. 15, 2014, for PCT/EP2013/074324.
Written Opinion dated Jan. 15, 2014, for PCT/EP2013/074324.

*Primary Examiner* — Tuyet Vo
(74) *Attorney, Agent, or Firm* — Bacon & Thomas, PLLC

(57) ABSTRACT

A method for controlling an illumination system having a plurality of colored light sources, with a plurality of colors including at least a first and a second color different from the first one, the illumination system for emitting illumination light and the sources controlled by control signals to provide respective luminances and hence a luminance and a color point of the system. The method having the steps of measuring at different instants the luminance of the system, determining at each measurement the active light sources and, hence, the emitted colors, determining the different luminances of the different colors and, hence, the variations of the luminance of the system and retro-modifying the control signals to reduce the variations.

20 Claims, 5 Drawing Sheets

(52) U.S. Cl.
CPC ..... *G09G 2320/0646* (2013.01); *G09G 2320/0666* (2013.01); *G09G 2330/025* (2013.01); *G09G 2330/06* (2013.01); *G09G 2360/145* (2013.01)

(56) References Cited

U.S. PATENT DOCUMENTS

| | | | | |
|---|---|---|---|---|
| 8,400,071 | B2 * | 3/2013 | Gaines | H05B 33/0815 315/185 S |
| 2007/0052375 | A1 * | 3/2007 | Lin | H05B 33/0818 315/312 |
| 2007/0171670 | A1 | 7/2007 | Zagar et al. | |
| 2008/0065345 | A1 | 3/2008 | Ooghe | |
| 2008/0278097 | A1 | 11/2008 | Roberts et al. | |
| 2009/0302781 | A1 | 12/2009 | Peker et al. | |
| 2011/0156596 | A1 | 6/2011 | Salsbury | |

* cited by examiner

METHOD FOR CONTROLLING ILLUMINATION FOR AN OPTICAL DISPLAY SYSTEM

TECHNICAL FIELD OF THE INVENTION

The instant invention relates to illumination systems and more particularly to optical display systems including a display layer, a backlight layer (the backlight) and a feedback control system for controlling the brightness and/or the colour of the light emitted by the display systems.

BACKGROUND OF THE INVENTION

Nowadays, displays are omnipresent in everyday life. Various technologies can be implemented in displays, such as Light Emitting Diodes (LEDs), Liquid Crystal Displays (LCDs), Organic Light Emitting Diodes (OLEDs) or Plasma Displays for instance. Displays can either produce light themselves without any backlight layer or either they can need an extra source of light, the so-called a backlight. LCDs belong to this second category as they need an illumination source—the backlight—to produce a visible image. Usually, a LCD is made up of liquid crystals which are arrayed in front of the backlight, of two transparent electrodes and of two polarising filters. By controlling the voltage applied across the liquid crystal layer in each pixel, light provided by the backlight can be allowed to pass through in varying amounts thus constituting different levels of gray. It should be noted that a pixel corresponds to a certain LCD surface.

The light source of a backlight can be made up of various sources such as OLEDs, Quantum Dots or phosphors. Most commonly, they are made up of one of several LEDs, for instance Red, Green and Blue (RGB) LEDs. Usually, the backlight is designed to emit a white light. By controlling the light emitted by each LED, one can change the brightness and "colour point" of the backlight. By "colour point", it should be understood the coordinates of the colour in the CIE 1931 xy chromaticity diagram.

The brightness and colour point of LEDs backlight can vary based on a number of conditions. For instance, a change in temperature or the ageing of LEDs can have strong impacts on the brightness level and colour point of LEDs. For certain applications, those changes are not acceptable. In a television for instance, the colour point of a backlight should be as stable as possible, in order to produce images as accurate as possible. In avionics, displays provide critical flight information to aircraft pilots. Such displays should be readable under a variety of lighting conditions.

Generally, backlight LEDs are controlled by Pulse Width Modulated (PWM) signals. In order to ensure the readability of displays, notably in avionics, but not only, a dynamic control of LEDs has been implemented in prior art and feedback control loops have been provided to stabilize the LEDs features. After measuring the LED temperature and the luminous flux of LEDs, PWM controllers can adjust PWM signals sent to LEDS to maintain the desired colour point and brightness level of LEDs.

Two main drawbacks remain to be overcome in LEDs backlights.

The first drawback is to reduce combined peak current. Combined peak current occur notably when PWM signals are the same for all LEDs, i.e. when all LEDs are switched ON and OFF respectively at the same time. This phenomenon is illustrated in FIG. 1 showing three PWM signals for three LEDs, respectively, with the function of combined current in the three LEDs. Peaks of power consumption are often created, involving issues of noise and electromagnetic compatibility. The peak current has influence on the power system. Big step loads make the power supply more complex and bigger. The induced effects of peak currents are even more problematic when large displays are used. The larger the displays, the bigger will be these step loads and the more problematic will be the induced effects. Indeed, when designing a display, specifications can be given by client, such as for instance a maximum of 5% of power modulation on the nominal power.

This means that for a nominal power of 50 W, the power consumption can vary between 47.5 and 52.5 W. The power required to illuminate large displays being higher than for small displays, by keeping the same specifications, this would create larger range of modulation. For a nominal power of 100 W and the same specification, the range of accepted values would be 95 to 105 W. This is not acceptable for clients who want to maintain the brightness of displays as stable as possible, and thus reduce the range of acceptable variation.

The second drawback concerns the reliability of luminous flux measurements. In a typical RGB backlight, a plurality of optical sensors can be used to measure the brightness of LEDs. Each sensor can be dedicated to a given colour. Unfortunately, the sensitivity of sensors being usually broad, an overlap between sensitivity spectrums can occur, as illustrated by FIG. 2. When measuring the brightness of a given colour, for instance blue, the sensor can measure the brightness of both blue and green LEDs, and the measure can be biased.

In prior art, several methods have been presented to optimize the feedback control loops by adjusting the PWM signals.

WO 2012/140634 discloses PWM signals which are phase-shifted in order to reduce combined peak current provided to the light sources, as illustrated in FIG. 3.

U.S. Pat. No. 8,175,841 describes a method for controlling an illumination system, according to which measurements of luminance are carried out by a single full spectrum optical sensor when only one single colour is switched on, in order to avoid measuring a biased colour point. Unfortunately, this method involves instability in power consumption i.e. combined peak current during the measure of colour points, as only one colour is switch on during this phase.

Despite what has been presented in prior art, a method remains to be proposed in order to measure non-biased colour points while keeping stable power consumption.

SUMMARY OF THE INVENTION

The present invention relates, in a first aspect, to a method for controlling an illumination system comprising a plurality of coloured light sources, with a plurality of colours including at least a first and a second colour different from the first one, the illumination system being for emitting illumination light and the sources being controlled by control signals to provide respective luminances and hence a luminance and a colour point of the system, the method comprising the steps of measuring at different instants the luminance of the system, determining at each measurement the active light sources and, hence, the emitted colours, determining therefrom the different luminances of the different colours and, hence, the variations of the luminance of the system and retro-modifying the control signal to reduce said variations.

It is an advantage of embodiments of the present application that the measurement of luminance of the system may be carried out at any time, even if several light sources of different colours i.e. different colour channel are active at the same moment. There is no need anymore to adapt or shift PWM signals in order to measure the luminance of only one colour channel.

It is a further advantage of embodiments of the present application that there is no need anymore of several optical sensors associated respectively with a given colour channel. Only one global optical sensor may be used to carry out luminance measurements over a broad spectral range.

It is a further advantage of embodiments of the present application that the peak current modulation of the illumination system may remain stable even during measurement steps.

It is yet another advantage of embodiments of the present application that they allow colour control of large displays.

The present invention may be particularly useful in avionics displays, but this is not limited thereto.

Advantages and novel features of the invention will become more apparent from the following detailed description when taken in conjunction with the accompanying drawing.

The present invention shall be better understood in light of the following description and the accompanying drawings.

DETAILED DESCRIPTION OF THE INVENTION

The present invention is directed to a method and a system for controlling the brightness and/or colour point of an illumination system comprising a plurality of coloured light sources while limiting power variation of the illumination system.

Figure 1:
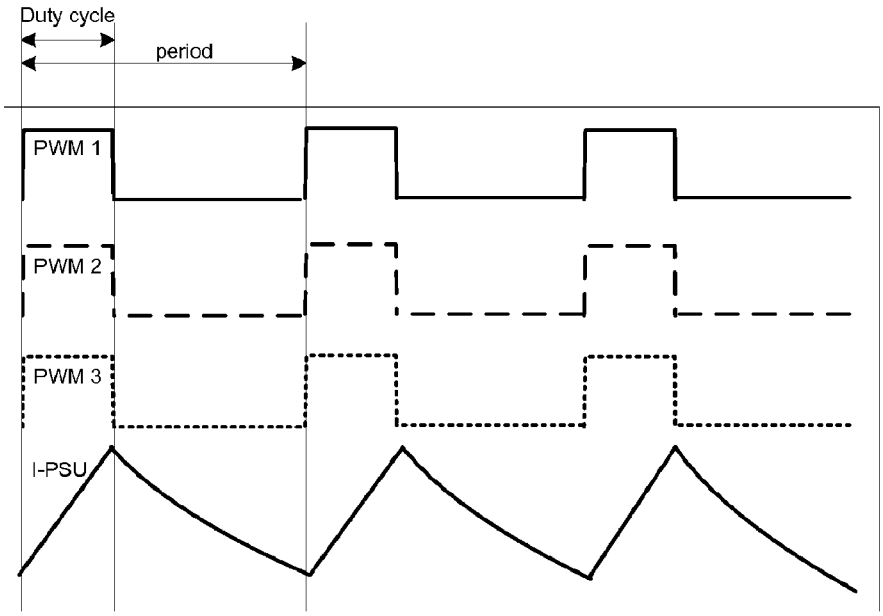
Figure 1 (PRIOR ART)
FIG. 1 illustrates the phenomenon of combined peak currents for PWM signal without phase-shifting in prior art.
Figure 2:
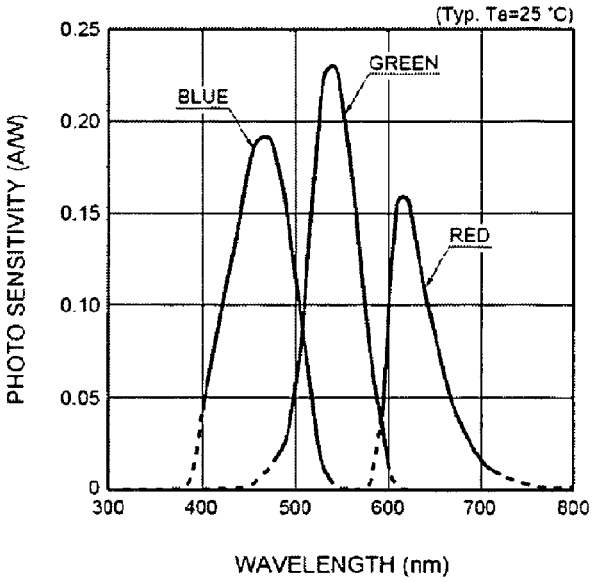
Figure 2 (PRIOR ART)
FIG. 2 is an illustration of spectral response of prior art red, green and blue optical sensors.
Figure 3:
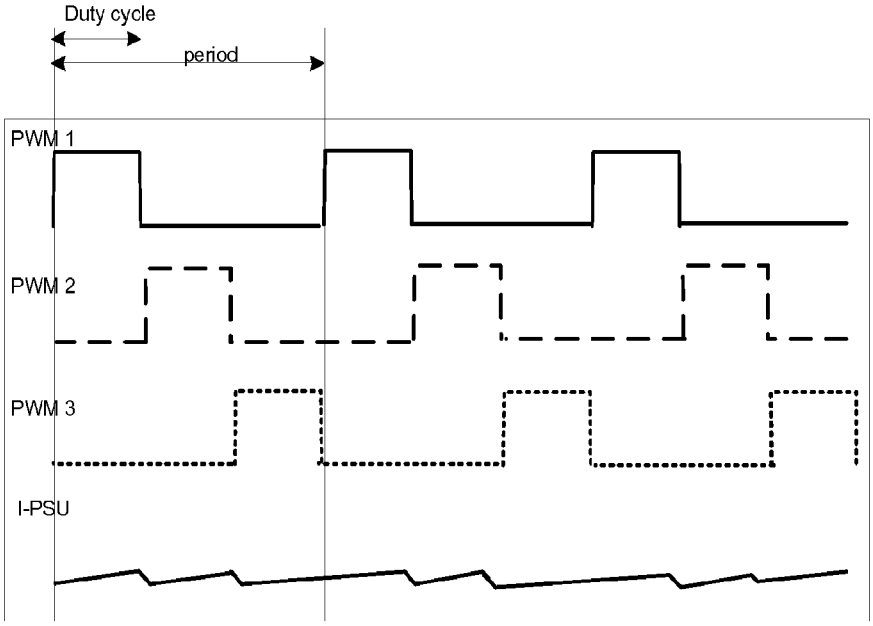
Figure 3 (PRIOR ART)
FIG. 3 illustrates the combined peak current for PWM signal with phase-shifting in prior art.
Figure 4:
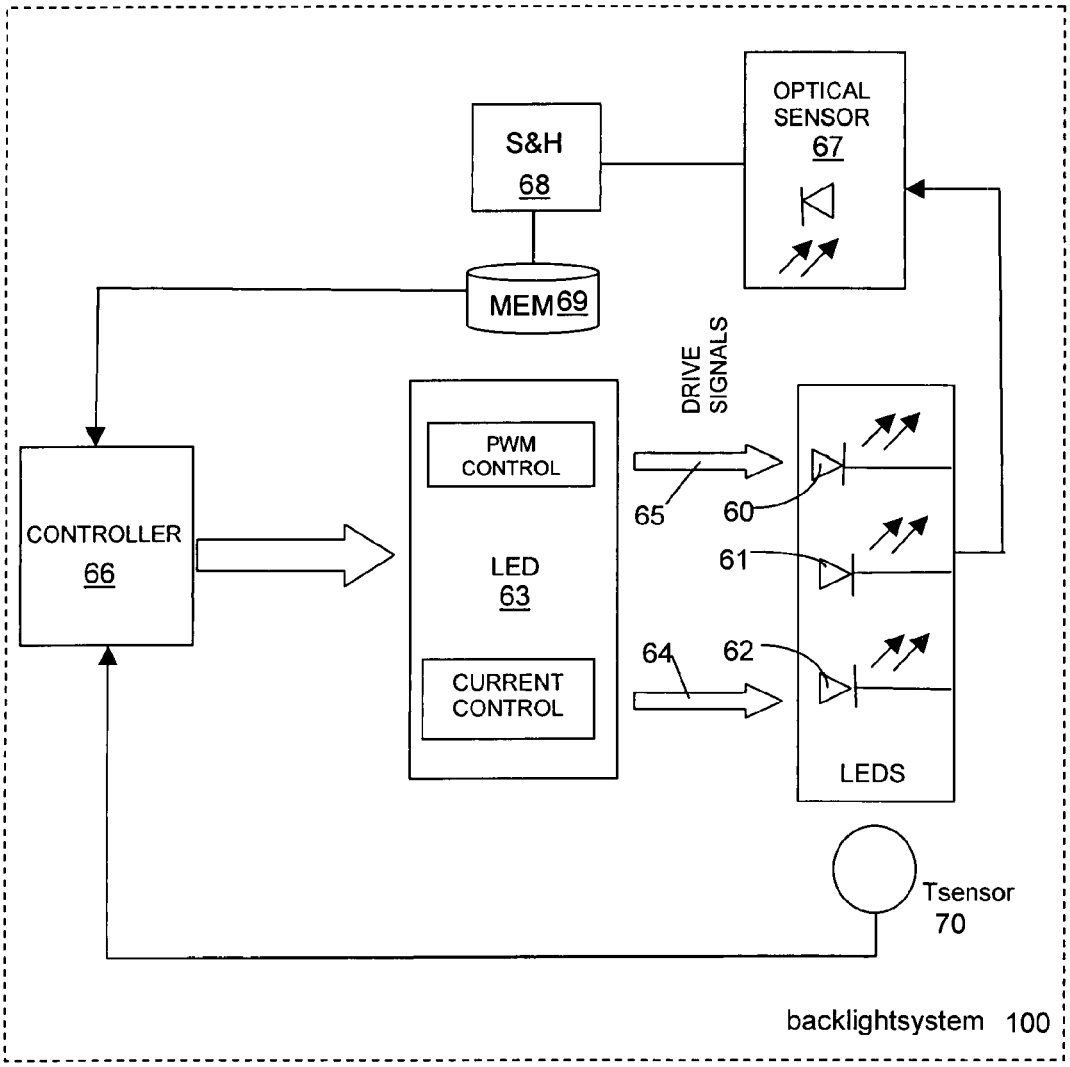
FIG. 4 illustrates functional components of a backlight system in accordance with embodiments of the present invention.

According to an exemplary embodiment, and as illustrated in FIG. 4, the illumination system or the backlight system 100 comprises a plurality of coloured light sources with a plurality of colours including at least a first colour and a second colour different from the first one, e.g. coloured LEDs of different colours, such as red, blue and green LEDs 60, 61, 62. The plurality of LEDs 60, 61, 62 may be combined into a plurality of colour channels, e.g. in the example given above a red, a green and a blue colour channel.

LEDs 60, 61 and 62 are controlled by a LED driver 63. The LED driver 63 may generate control signals such as a drive current control signal 64 and a Pulse Width Modulation (PWM) control signal 65. The drive current control signal 64 controls the current flowing through the LEDs. The PWM control signal 65 controls the power to the LEDs. The combination of the drive current control signal 64 and the PWM control signal 65 to an LED 60, 61, 62 determines the ON time and the emitted luminance of the LEDs 60, 61, 62.

The LED driver 63 itself is preferably controlled by a controller 66. The controller 66 may include a digital processing or computing device, e.g. a microprocessor, for instance it may be a micro-controller. In particular, it may include a programmable LED driver controller, for instance a programmable logic device such as a Programmable Array Logic (PAL), a Programmable Logic Array (PLA), a Programmable Gate Array (PGA), especially a Field Programmable Gate Array (FPGA). The controller 66 may be programmed by suitable software that carries out any of the methods of the present invention.

The controller 66 may store calibration values of all colours such as luminance, temperature and chromaticity over temperature behaviour.

In accordance with embodiments of the present invention, the illumination system i.e. the illumination system i.e. the backlight system 100 is provided with at least one optical sensor 67, i.e. at least one sensor which is adapted to sense the light output from the light source channels, thus generating an optical sensor value for the colour channels of the backlight system 100. The optical sensor 67 may be a photodiode. The optical sensor may 67 be any sensor that covers a spectral range of interest, depending on the light sources 60, 61, 62 in the illumination system, e.g. a sensor that covers the visible spectral range. The optical sensor 67 may e.g. have a spectral range from 400 to 700 nm.

The optical sensor 67 may be coupled to a sample and hold circuit 68 which may sample the measurement value of the optical sensor 67 and optionally store it in a memory 69 where it may be fetched by the controller 66. This storing of a measurement value in the memory 69 may in particular be used when the light sources of the different colours are first sampled in sequence, the calculation of luminance values associated to each colour channel and the recalculation of the drive settings into second drive settings being performed only after the measurement values in the plurality of colour channels have been generated.

Optionally, the illumination system i.e. the backlight system 100 in accordance with embodiments of the present invention may also be provided with a temperature sensor 70, for sensing the temperature of the light sources, e.g. LEDs 60, 61, 62.

The controller 66 reads out from the sensors 67, 70 the optical sensor value and optionally ambient conditions such as LED temperature. Based on these measurements, the controller 66 calculates the values of luminance associated to each channel and by comparing the calculated luminance with the pre-determined or desired luminance, correction values for the drive signals 64, 65 to the LEDs 60, 61, 62 are determined. This is done during real-time, i.e. measurements are made and corrections to the drive signals 64, 65 are applied while the light source is in use for a real application. Indeed, the measurement and controlling cannot introduce artefacts to the user.

With "in use for a real application" is meant, e.g. for a backlight display, while data content is being displayed to a user, rather than during calibration or during setting-up of the display system. The corrections are so as to obtain a controlled colour point and/or luminance of the light source, e.g. backlight.

Figure 5:
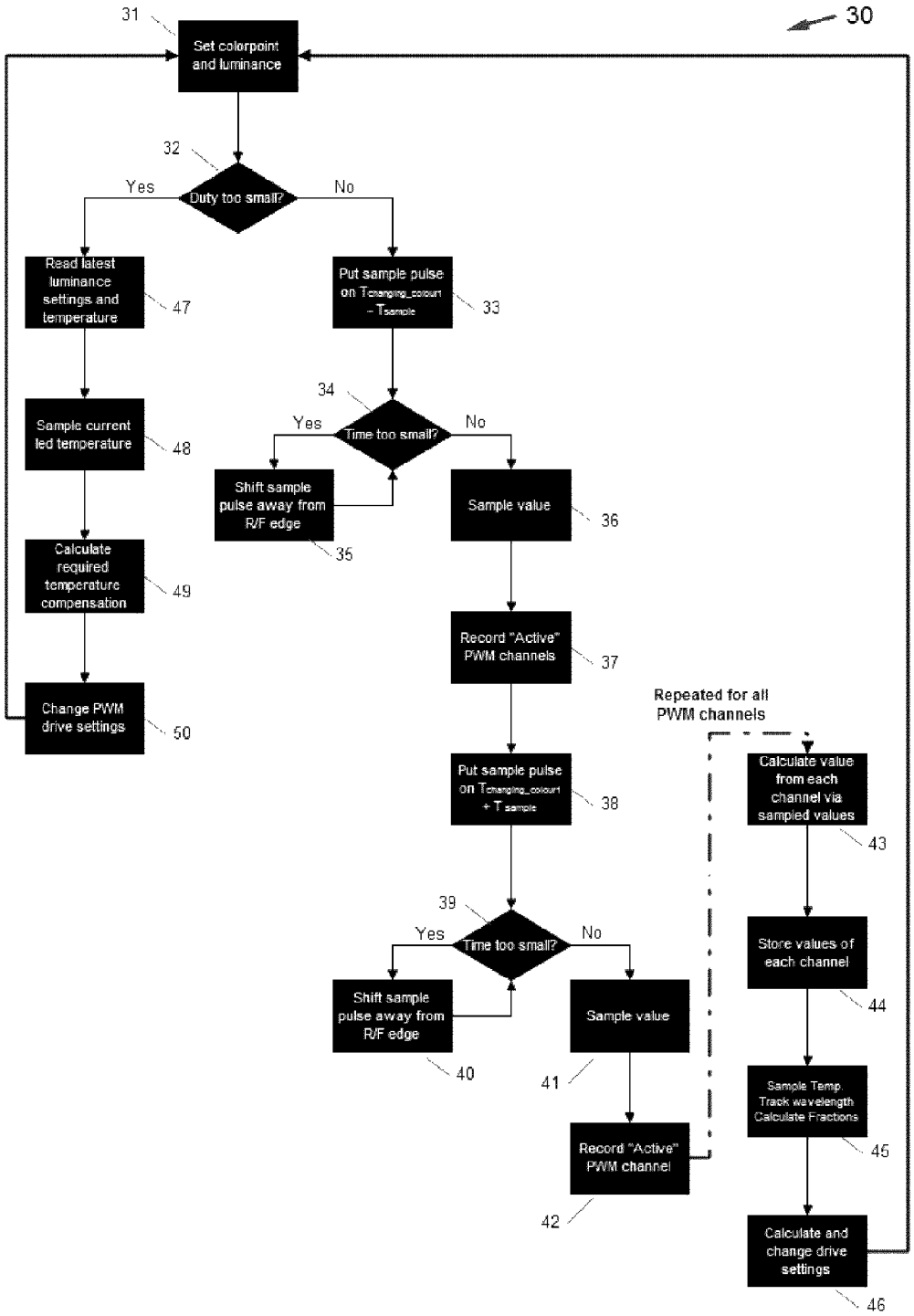
FIG. 5 is a block diagram of a feedback process in accordance with embodiments of the present invention.

A flow chart 30 of an embodiment of the method of the present invention is illustrated in FIG. 5. First, in step 31, first control signals i.e. first drive settings for each of the plurality of coloured light sources are determined so as to provide illumination light with a pre-determined colour point and/or a pre-determined luminance. In accordance with the present invention, if the duty cycle is high enough (check made in step 32), i.e. if the pulse width of the shortest colour pulse is larger than the addition of the response time of the sensor and the sample time, i.e. at low dimming and thus at high brightness, the system selects a first channel (i.e. a first colour) and determine the next change occurring for this channel, i.e. the next time $T_{changing_colour1}$ when the selected channel become active (i.e. is switched ON) or inactive (i.e. is switched OFF). A first time of measurement $T_{before}$ is determined, step 33, such that the sample pulse at $T_{before}$ occurs before the change of the first colour selected, i.e. in other words, such that $T_{before}=T_{changing_colour1}-T_{sample}$, $T_{sample}$ being a predetermined value. If this predetermined time $T_{sample}$ is too small (check made in step 34), then, in step 35, the sample pulse is shifted away from the edge by determining a new value of $T_{sample}$. Once the value of $T_{sample}$ is appropriate, then the luminance of the first colour selected is measured at $T_{before}$. This measure is carried out at step 36. The sampled value during step 36 can represent one or more active colours. In step 37, PWM channels which were active during step 36 are recorded in a memory 69. Then, in step 38, the sample pulse is shifted to $T_{after}$, such that the sample pulse at $T_{after}$ occurs after the change of the first colour selected, i.e. in other words, such that $T_{after}=T_{changing_colour1}-T_{sample}$. If the predetermined time $T_{sample}$ is too small (check made in step 39), then, in step 40, the sample pulse is shifted away from the edge by determining a new value of $T_{sample}$. Once the value of $T_{sample}$ is appropriate, then the luminance of the first colour selected is measured at $T_{after}$.

This measure is carried out at step 41. The sampled value during step 41 can represent one or more active colours.

In step 42, PWM channels which were active during step 41 are recorded and stored in memory 69.

In other words, the luminance of the illumination system is measured at different instants in steps 36 and 41. Those measurements may be performed before and after the sources of a colour become active. In step 37 and 42, the active light sources and, hence, the emitted colours during steps 36 and 41 respectively are determined.

Steps 33 to 42 are then repeated for all PWM channels i.e. for each colour. At the end of those steps, a value of luminance is calculated for each colour channel via sampled values in step 43. This step of calculation will be explained in the following. In step 44, calculated values of luminance are stored in the memory 69 for each channel.

From the stored values stored in step 44 in the memory 69, the controller 66 calculates the drive settings (current control signal 64 and PWM control signal 65), step 46, to maintain the desired mixed colour point, e.g. white colour point. In other words, in step 46, the control signals are retro-modified to reduce the variations of the luminance and colour point of the illumination system 100.

Then, according to embodiments of the present invention, a temperature sensor 70 may be provided for sensing the temperature of the light sources, e.g. LEDs 60, 61, 62. Based on the measured temperature, a wavelength shift of the colour LEDs 60, 61, 62 may be tracked by means of look-up tables indicating wavelength shift in function of temperature. The fractions of the colours are then recalculated by using new x,y-coordinates for the colours which have wavelength shifted, and these recalculated fractions are used as input for the luminance compensation. This is illustrated in method step 45. In other words, the control signals may be retro-modified to reduce the variations of the colour point of the illumination system 100.

Furthermore, for high dimming applications (check made in method step 32 of FIG. 5), embodiments of the present invention provide temperature compensation. If the luminance/duty cycle is very low, high dimming occurs. If the dimming ratio is higher than the response time of the sensor, PWM pulses are too short to be sampled, and the feedback system in accordance with embodiments of the present invention may be provided with switching means switching the control to a temperature control algorithm based on lookup tables and the last luminance measurements, as illustrated in the left hand side of FIG. 4. The system thus automatically switches to temperature compensation based on the latest luminance values measured during high brightness or thus low dimming mode, step 47, and on a measured current temperature of the light source, e.g. LED, step 48. The measured luminance and temperature values are used to calculate the required driver settings to maintain the programmed colour point, step 49. The driver settings are changed accordingly, step 50.

As an example only, calculations carried out in step 43 may be carried out as follows. Calculation will be explained by referring to a system of four colour channels, but this is not limited thereto. Calculations may be performed for any numbers of channels following the same reasoning.

Figure 6:
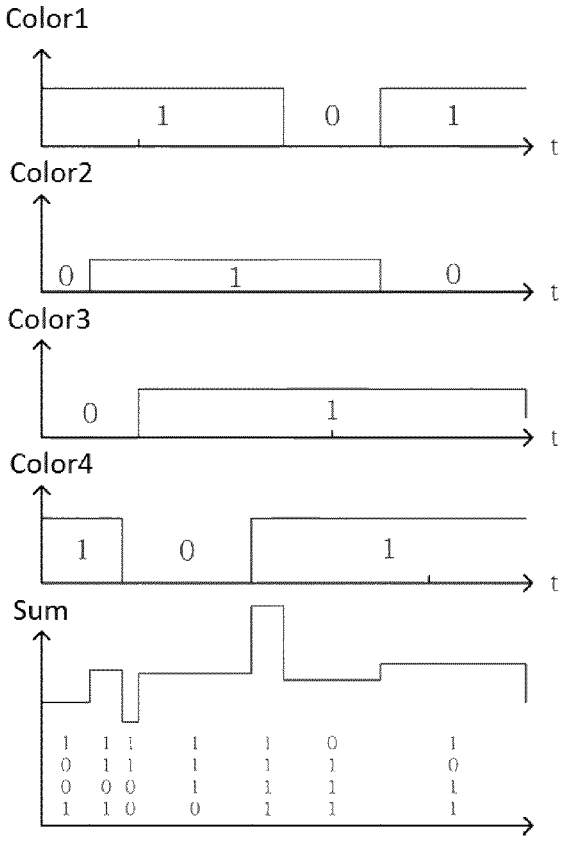
FIG. 6 is an example of PWM signals controlling 4 colour channels.

In FIG. 6, an example of PWM signals controlling 4 channels is given. According to the method disclosed above, luminance of each channel is recorded before and after each time that channels are changing i.e. become active (switched ON) or inactive (switched OFF). The last graph of FIG. 6 is the sum of colour 1 to colour 4 signals. It represents the values which are measured and recorded in steps 36 and 41. Indeed, sampled values during those steps can represent one or more active colours and can correspond to the sum of the luminance of the channel which are active during the measurement. The fact that active PWM channels are recorded in steps 37 and 42 enables to establish the following linear system, for instance:

$$Color_1+Color_4=Color_{1+4} \quad (1)$$

$$Color_1+Color_2+=Color_{1+2+4} \quad (2)$$

$$Color_1+Color_2=Color_{1+2} \quad (3)$$

$$Color_1+Color_2+Color_3=Color_{1+2+3} \quad (4)$$

$$Color_1+Color_2+Color_3+=Color_{1+2+3+4} \quad (5)$$

$$Color_2+Color_3+=Color_{2+3+4} \quad (6)$$

$$Color_1+Color_3+=Color_{1+3+4} \quad (7)$$

The left hand-side of equations is given by data recorded in step 37 and 41 whereas the right hand-side is provided by measurements carried out in steps 36 and 41.

In this particular example, there are 4 unknowns: Colon, $Color_2$, $Color_3$ and $Color_4$. This is a well known linear system which requires choosing 4 appropriate equations. The matrix formulation of this system is Ax=b. The solution x is the vector $x=A^{-1}b$. The selection of equations may be done so that the determinant det(A) does not equal 0. By selecting for instance equations (1), (2), (4) and (7), det(A) equals 1.

$$\mathrm{Det}(A) = \begin{vmatrix} 1 & 0 & 0 & 1 \\ 1 & 1 & 0 & 1 \\ 1 & 1 & 1 & 0 \\ 1 & 0 & 1 & 1 \end{vmatrix} = 1$$

By assigning measured values to the selected equations, one can calculate each unknown. For instance, for illustration purpose only, the measured values may be the followings:

$$\mathrm{Color}_{1+4} = 1570$$

$$\mathrm{Color}_{1+2+4} = 1768$$

$$\mathrm{Color}_{1+2+3} = 879$$

$$\mathrm{Color}_{1+3+4} = 1975$$

$$\text{i.e. } b = \begin{vmatrix} 1570 \\ 1768 \\ 879 \\ 1975 \end{vmatrix}$$

Then, with $$A = \begin{vmatrix} 1 & 0 & 0 & 1 \\ 1 & 1 & 0 & 1 \\ 1 & 1 & 1 & 0 \\ 1 & 0 & 1 & 1 \end{vmatrix}$$

and $$A^{-1} = \begin{vmatrix} 2 & -1 & 1 & -1 \\ -1 & 1 & 0 & 0 \\ -1 & 0 & 0 & 1 \\ -1 & 1 & -1 & 1 \end{vmatrix}$$

$$\text{If } b = \begin{vmatrix} 1570 \\ 1768 \\ 879 \\ 1975 \end{vmatrix} \text{ then } x = A^{-1}b = \begin{vmatrix} 276 \\ 198 \\ 405 \\ 1294 \end{vmatrix}$$

This means that luminance value of channels 1, 2, 3 and 4 are respectively 276, 198, 405 and 1294. Those values can then be stored in step 44 and be used for color stabilization or mixed color point calculations, performed in step 45 and 46.

The invention claimed is:

1. A method for controlling an illumination system comprising a plurality of coloured light sources, with a plurality of colours including at least a first colour and a second colour different from the first one, the illumination system being for emitting illumination light and the sources being controlled by control signals to provide respective luminances and a luminance and a colour point of the system, the method comprising the steps of:

measuring at different instants a luminance of the system, determining at each measurement active light sources and emitted colours, determining therefrom different luminances of different colours of the plurality of colours and variations of the luminance of the system and retro-modifying the control signals to reduce said variations, wherein the step of measuring comprises:

determining an instant when the sources of a colour are changing, measuring the luminance of the system before and after this determined instant.

2. The method according to claim 1, further comprising the step of determining the variations of the colour point of the system.

3. The method according to claim 1, further comprising directly or indirectly measuring temperature of the coloured light sources.

4. The method according to claim 3, further comprising the step of determining the variations of the colour point of the system.

5. The method according to claim 1, wherein the step of determining the variations of the luminance of the system comprises the steps of:

establishing a linear system of relationships between the different luminances of the different colours and the luminance of the system, solving this linear system.

6. The method according to claim 5, wherein the control signals comprise current control signals and pulse width modulation control signals.

7. The method according to claim 6, further comprising directly or indirectly measuring temperature of the coloured light sources.

8. The method according to claim 7, further comprising the step of determining the variations of the colour point of the system.

9. The method according to claim 5, further comprising directly or indirectly measuring temperature of the coloured light sources.

10. The method according to claim 9, further comprising the step of determining the variations of the colour point of the system.

11. The method according to claim 1, wherein the control signals comprise current control signals and pulse width modulation control signals.

12. The method according to claim 11, further comprising directly or indirectly measuring temperature of the coloured light sources.

13. The method according to claim 12, further comprising the step of determining the variations of the colour point of the system.

14. A method for controlling an illumination system comprising a plurality of coloured light sources, with a plurality of colours including at least a first colour and a second colour different from the first one, the illumination system being for emitting illumination light and the sources being controlled by control signals to provide respective luminances and a luminance and a colour point of the system, the method comprising the steps of:

measuring at different instants a luminance of the system, determining at each measurement active light sources and emitted colours, determining therefrom different luminances of different colours of the plurality of colours and variations of the luminance of the system and retro-modifying the control signals to reduce said variations, wherein the step of determining the variations of the luminance of the system comprises the steps of:

establishing a linear system of relationships between the different luminances of the different colours and the luminance of the system, solving this linear system.

15. The method according to claim 14, further comprising the step of determining the variations of the colour point of the system.

16. The method according to claim 14, further comprising directly or indirectly measuring temperature of the coloured light sources.

17. The method according to claim 16, further comprising the step of determining the variations of the colour point of the system.

18. The method according to claim 14, wherein the control signals comprise current control signals and pulse width modulation control signals.

19. The method according to claim 18, further comprising directly or indirectly measuring temperature of the coloured light sources.

20. The method according to claim 19, further comprising the step of determining the variations of the colour point of the system.

* * * * *